US009612079B2

(12) United States Patent
EuDaly

(10) Patent No.: US 9,612,079 B2
(45) Date of Patent: Apr. 4, 2017

(54) RUBBER BAND GUN, METHOD OF USE, AND METHOD OF ASSEMBLY

(71) Applicant: Brent A. EuDaly, Centerville, KS (US)

(72) Inventor: Brent A. EuDaly, Centerville, KS (US)

( * ) Notice: Subject to any disclaimer, the term of this patent is extended or adjusted under 35 U.S.C. 154(b) by 0 days.

(21) Appl. No.: 15/180,951

(22) Filed: Jun. 13, 2016

(65) Prior Publication Data

US 2016/0363412 A1 Dec. 15, 2016

Related U.S. Application Data

(60) Provisional application No. 62/174,522, filed on Jun. 12, 2015.

(51) Int. Cl.

| | |
|---|---|
| ***F41B 7/02*** | (2006.01) |
| ***F41B 7/08*** | (2006.01) |
| ***F41B 7/00*** | (2006.01) |
| ***F41C 23/14*** | (2006.01) |
| ***A63H 5/04*** | (2006.01) |

(52) U.S. Cl.

CPC ..... *F41B 7/025* (2013.01); *A63H 5/04* (2013.01); *F41B 7/003* (2013.01); *F41C 23/14* (2013.01)

(58) Field of Classification Search

CPC ..... F41B 7/025; A63H 5/04

USPC ..... 124/17, 18, 19, 35.1; 446/473

See application file for complete search history.

(56) References Cited

U.S. PATENT DOCUMENTS

| | | | | | |
|---|---|---|---|---|---|
| 1,234,163 | A * | 7/1917 | Henderson | F41B 3/02 | 124/17 |
| 1,723,554 | A | 8/1929 | Mallott | | |
| 1,724,708 | A * | 8/1929 | Harris | F41B 7/025 | 124/19 |
| 1,759,084 | A | 5/1930 | Baum et al. | | |
| 1,821,381 | A * | 9/1931 | Gerken | F41B 7/025 | 124/19 |
| 1,883,826 | A | 10/1932 | Schmidt | | |
| 1,909,927 | A * | 5/1933 | Beauchamp | F41B 7/025 | 124/19 |
| 1,921,017 | A * | 8/1933 | Weber | F41B 3/005 | 124/17 |
| 2,008,595 | A * | 7/1935 | Reed | F41B 7/025 | 124/19 |
| 2,098,001 | A * | 11/1937 | Gagnon | F41B 7/025 | 124/19 |
| 2,289,490 | A * | 7/1942 | Fisher | F41B 7/025 | 124/19 |
| 2,462,723 | A * | 2/1949 | Crnich | F41B 7/025 | 124/19 |
| 2,529,047 | A * | 11/1950 | Paul | F41B 7/025 | 124/19 |
| 2,550,873 | A * | 5/1951 | Siders | F41B 7/025 | 124/19 |

(Continued)

*Primary Examiner* — Alexander Niconovich

(74) *Attorney, Agent, or Firm* — Law Office of Mark Brown, LLC; Christopher M. DeBacker

(57) ABSTRACT

An elastic rubber band launching toy gun that uses a new method to launches 24 elastic bands in rapid succession using a simple assembly of only 13 individual parts, and featuring an optional, adjustable, sliding shoulder support stock. It is designed to resemble a Heckler & Koch MP5 firearm, as manufactured by Heckler & Koch GmbH of Oberndorf am Neckar, Germany. The rubber band gun includes a slideable, lockable stock which can be slid and locked into multiple lengths away from the butt of the firearm.

2 Claims, 3 Drawing Sheets

(56) References Cited

U.S. PATENT DOCUMENTS 2,576,248 A * 11/1951 Wright ..... F41B 7/025 124/19
2,625,147 A * 1/1953 Eagleson, Jr. ..... F41B 7/025 124/19
2,689,558 A * 9/1954 Sealer ..... F41B 7/025 124/19
2,697,425 A * 12/1954 McElveen ..... F41B 7/025 124/19
2,741,238 A * 4/1956 Arnold ..... F41B 7/025 124/19
2,793,635 A * 5/1957 Koeller ..... F41B 7/025 124/18
2,878,802 A * 3/1959 Kuch ..... F41B 7/025 124/19
2,917,037 A * 12/1959 Henderson ..... F41B 7/025 124/19
3,137,958 A * 6/1964 Lewis ..... F41C 23/14 42/73
3,437,084 A * 4/1969 Hyter ..... F41B 7/025 124/19
3,468,296 A * 9/1969 Duval ..... F41B 7/025 124/19
3,494,345 A * 2/1970 Griffiths ..... F41B 7/025 124/19
3,812,833 A * 5/1974 Skillern ..... F41B 7/025 124/19
3,919,996 A * 11/1975 McAlister ..... F41B 7/025 124/19
4,033,313 A * 7/1977 Ryan ..... F41B 7/025 124/17
4,165,729 A * 8/1979 Niemirow ..... F41B 7/00 124/17
4,308,850 A * 1/1982 Hunter ..... F41B 7/025 124/19
4,379,445 A * 4/1983 LoBiondo ..... F41B 7/025 124/19
4,676,219 A * 6/1987 Miller ..... F41B 7/025 124/19
4,800,864 A * 1/1989 Small ..... F41B 7/025 124/19
4,949,494 A * 8/1990 Mims ..... F41B 7/025 124/19
5,170,770 A * 12/1992 Vosloh ..... F41B 7/025 124/19
5,205,266 A * 4/1993 Kilby, Jr. ..... F41B 7/025 124/19
5,222,472 A * 6/1993 Landingham ..... F41B 7/025 124/19
5,460,150 A * 10/1995 Joppe ..... F41B 7/025 124/19
5,595,165 A * 1/1997 Conte ..... A63H 5/04 124/18
5,692,489 A * 12/1997 Swanson ..... F41B 7/02 124/19
7,690,371 B2 * 4/2010 Slaven ..... F41B 3/005 124/18
8,061,072 B1 * 11/2011 Crose ..... F41C 23/04 42/71.01
8,607,771 B1 * 12/2013 Marsh ..... F41B 7/025 124/19
2008/0029104 A1 2/2008 Vanderpool
2009/0314272 A1 * 12/2009 Lin ..... F41A 9/74 124/48
2013/0340734 A1 * 12/2013 Coulston ..... F41B 7/025 124/19

* cited by examiner

RUBBER BAND GUN, METHOD OF USE, AND METHOD OF ASSEMBLY

CROSS-REFERENCE TO RELATED APPLICATION

This application claims priority in U.S. Provisional Patent Application No. 62/174,522 Filed Jun. 12, 2015, which is incorporated herein by reference.

BACKGROUND OF THE INVENTION

1. Field of the Invention

The present invention relates generally to a rubber band gun and method for use and assembly thereof, and more specifically to rubber band launching toy gun that fires 24 rubber bands in rapid succession, releasing only one rubber band with each trigger pull.

2. Description of the Related Art

Elastic rubber band launching toy guns exist in many forms, ranging from very simple single shot models to extremely complex models capable of launching hundreds of elastic bands in a matter of seconds.

Traditional rubber band guns use a variety of mechanisms to hold a band in a stretched position and for releasing that band, resulting in the band being "fired" from the gun toward a target. The simplest such release mechanism uses a simple clothespin which can clasp down on the band and causes the band to be released upon depressing the pin. This results in a simple, yet limited single-fire pistol.

The most common style of elastic band launching gun uses a plastic, multi-toothed rotating wheel to release rubber bands in a controlled manor one at a time. Another type of elastic band launching gun uses a "step-up" action to move a collection of individual elastic bands up a series of notches, releasing one elastic band off of the topmost notch with each advancement of the action More complicated rubber band guns include repeater pistols which rely upon a tooth wheel which spins as the trigger is depressed. These pistols allow for a rapid succession of shots, but each shot will only fire the band or bands as they are loaded onto the wheel. There is no way to load up additional bands for firing using the wheel mechanism alone.

Heretofore there has not been available a system or method for a rubber band gun with the advantages and features of the present invention.

BRIEF SUMMARY OF THE INVENTION

The present invention relates generally to an elastic rubber band launching toy gun that uses a new method to launches 24 elastic bands in rapid succession using a simple assembly of only 13 individual parts, and featuring an optional, adjustable, sliding shoulder support stock. It is designed to resemble a Heckler & Koch MP5 firearm, as manufactured by Heckler & Koch GmbH of Oberndorf am Neckar, Germany.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Model MP5 Rubber Band Gun 2

Figure 1:
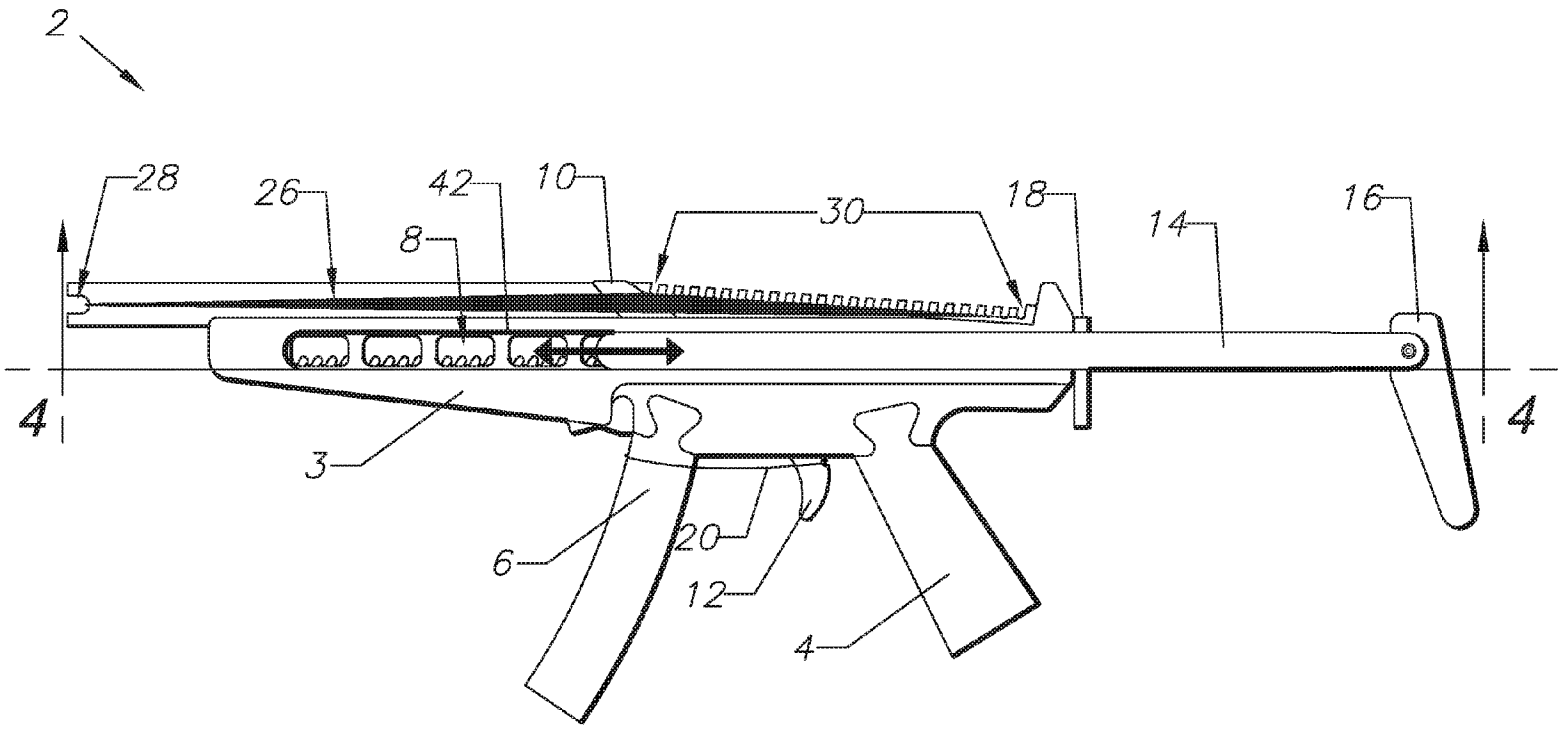
FIG. 1 is a side elevational view of a preferred embodiment of the present invention in the form of a replica MP5 firearm.
Figure 2:
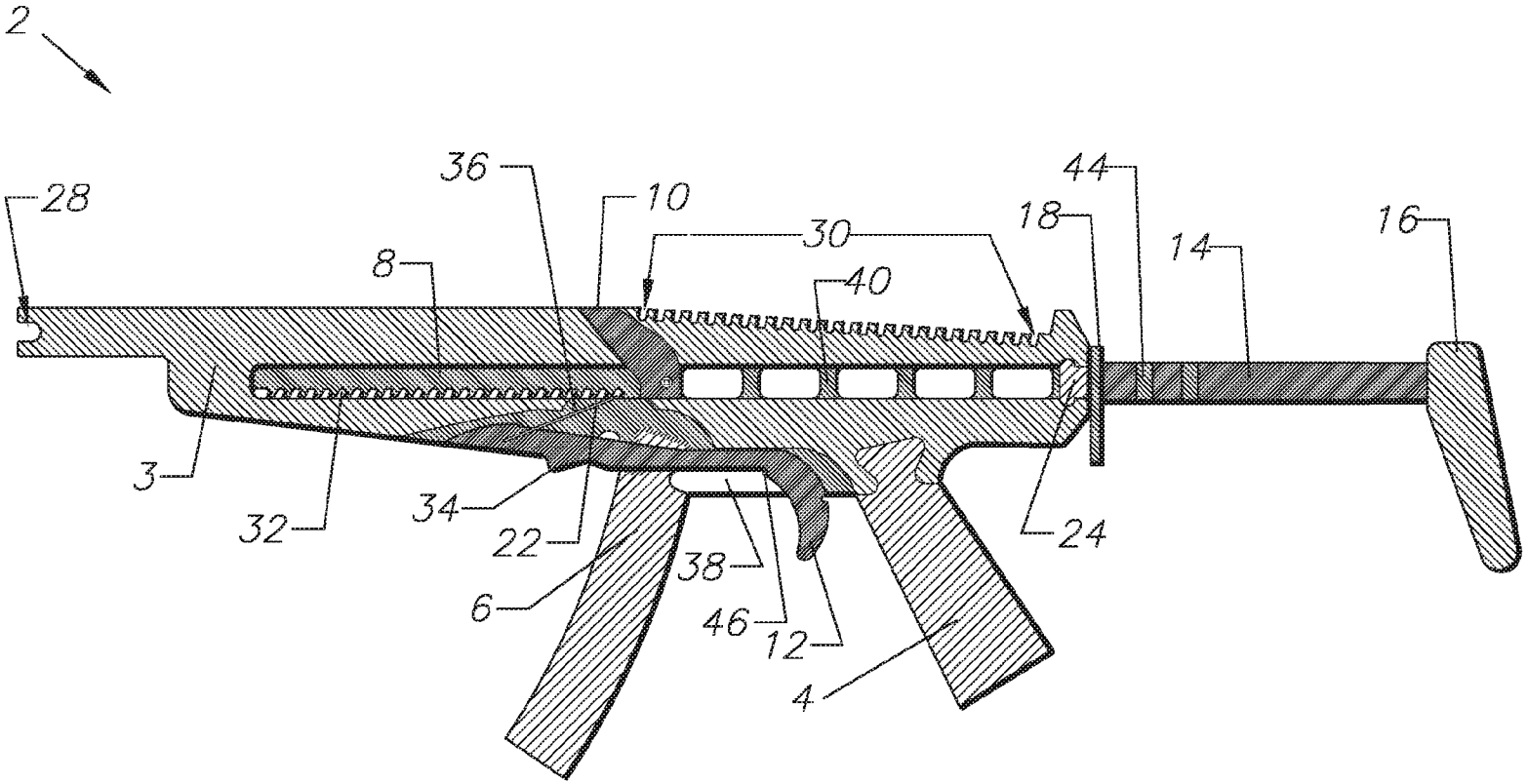
FIG. 2 is a sectional view thereof, taken about the line of FIG. 3.
Figure 3:
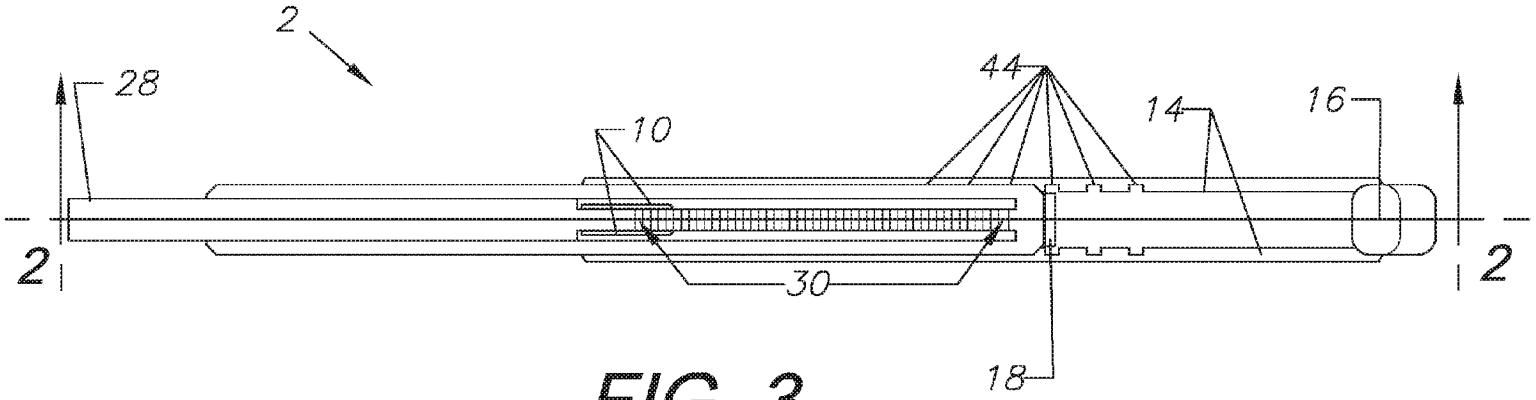
FIG. 3 is a top plan view thereof.
Figure 4:
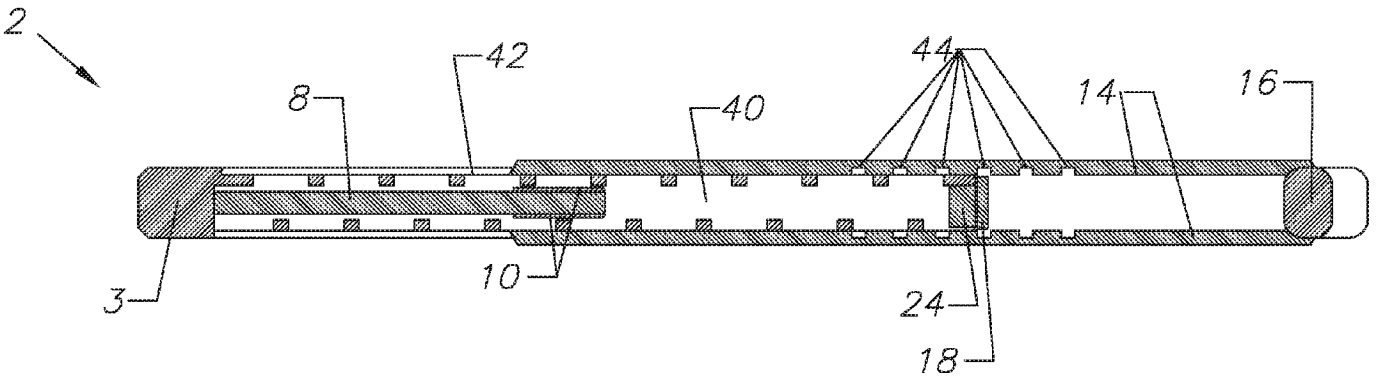
FIG. 4 is a top plan sectional view taken about the line of FIG. 1.

As shown in FIGS. 1-4, a preferred embodiment of the present invention rubber band gun 2 is formed in the shape of a model MP5 firearm. This embodiment is constructed from thirteen parts. A main gun frame 3, a handle 4, a magazine 6, a notched slide 8, a pair of firing wedges 10, a trigger 12, a trigger reset band 20, a trigger clutch 22, a clutch reset pin 36, a trigger 12, a trigger stop pin 46, and a set of twenty-four elastic rubber band projectiles 26.

The elastic band projectiles are stretched from the front notch 28, to each of the twenty-four rear notches 30 with one band in each notch. When the operator pulls the trigger 12 from a first, loaded position to a second, firing position, it pulls towards the operator while moving only within the constraints of the trigger stop pin 46 in the front, the handle 4 in the rear, and the walls of the trigger grove 38 on either side. As the trigger moves rearward, the attached trigger clutch 22 engages the first of the twenty-four slide notches 32 in the notched slide 8, thus pulling the notched slide 8 and the attached pair of firing wedges 10 rearward, moving only within the constraints of the slide cavity 40.

The pair of firing wedges 10 then dislodge the elastic rubber band projectile 26 from the first notch 30 in the main gun frame 3. The dislodged rubber band projectile 26 then rolls up the edge of the firing wedges 10 and releases its stored potential energy as it launches forward away from the operator and the gun 2. When the operator releases the trigger 12, the trigger reset band 20 pulls the trigger forward to its original, loaded position and the trigger clutch 22 flexes downward as it moves forward allowing it to engage in the second of the twenty-four slide notches 32. This process is repeated until all twenty-four elastic rubber band projectiles have been discharged. To reset the firing wedges 10, and prepare the rubber band gun 2 for reloading, the operator presses on the firing wedge reset button 34, which is located on the front end of the trigger 12. Pressing on the firing wedge reset button 34 flexes the trigger clutch 22 against the clutch reset pin 36, causing the trigger clutch 22 to disengage from the slide notches 32, and thus allowing the operator to freely move the firing wedges 10 and the notched slide 8, back to its original position. The Rubber Band Gun 2 may then be reloaded with elastic rubber band projectiles 26, as previously described.

The Rubber Band Gun 2 is also equipped with an optional, adjustable, sliding shoulder support stock that is generally comprised of four parts: a shoulder stock 16, a pair of stock supports 14, a stock support locking cam 18, and a cam nut 24. The shoulder stock 16 is fastened to the pair of stock supports 14 which slide into the dovetail shaped stock support groove 42. The shoulder support stock assembly is free to slide forward and backward within the constraints of the stock support groove 42 as shown by the arrow in FIG. 1, allowing the entire assembly to be "collapsed" for storage or extended to the desired length for use. The pair of stock supports 14, each have a series of six notches 44 cut into their inside face. These notches 44 are used for locking the shoulder support stock assembly in a desired extended position. To lock the shoulder support stock assembly, the operator rotates the stock support locking cam 18, around the cam nut 24 pivoting the top and bottom ends of the cam 18 into the desired notch 44, and thus preventing the shoulder support stock from sliding frontwards or backwards. To collapse the shoulder support stock for storage, the stock support locking cam 18 is rotated back to its original position allowing the shoulder support stock to slide forwards into a compact position.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A toy gun comprising:

a gun frame formed from a single piece of material, the gun frame including a handle, a trigger groove, a slide cavity, a front notch, a plurality of rear notches, and a mock magazine;

a trigger assembly including a trigger, a trigger band, a trigger stop pin, a trigger clutch, and a pair of firing wedges;

a plurality of elastic projectiles stretched between said front notch and said plurality of rear notches while said trigger is in a first, loaded position;

said trigger configured to be moved to a second, fired position, whereby a first of said plurality of elastic projectiles is dislodged by said pair of firing wedges and fired away from said gun frame front notch;

a notched slide including a plurality of slide notches configured for receiving said trigger clutch;

wherein said trigger is pulled back to said first, loaded position by said trigger band, and said trigger clutch is configured to advance to a next of said plurality of slide notches, thereby advancing said pair of firing wedges;

said gun frame including a stock slide groove, said stock slide groove being dovetail-shaped;

a stock assembly including a shoulder stock, a pair of stock supports, a locking cam, and a cam nut;

said shoulder stock fastened to said pair of stock supports which slideably engage with said stock slide groove;

said stock assembly thereby being slideably engaged with said gun frame to slide from a first, extended position to a second, collapsed position within said stock slide groove; and said stock supports including a plurality of stock notches configured for locking said stock assembly within said slide groove via said locking cam and said cam nut.

2. The toy gun of claim 1, further comprising:

a firing wedge reset button connected to a front end of said trigger, which is configured to flex the trigger clutch against a clutch reset pin, thereby disengaging said slide notches; and wherein said firing wedges are thereby configured to be removed and said notched slide configured to be replaced to an original first position for reloading the gun.

* * * * *